United States Patent [19]

Price et al.

[11] 3,948,011

[45] Apr. 6, 1976

[54] PARTITION SYSTEM FOR A BUILDING

[76] Inventors: Reginald Stanley Price, 3228 - 6th St., SW., Calgary, Alberta; Robert Stanley Agar, 16 Willow Wood Court, Willowdale, Ontario; Stanley Elden Thorsell, 121 Conifer St., Sherwood Park, Alberta, all of Canada

[22] Filed: Aug. 14, 1974

[21] Appl. No.: 487,821

Related U.S. Application Data

[63] Continuation-in-part of Ser. No. 293,662, Sept. 29, 1972, abandoned.

[52] U.S. Cl. ..... 52/241; 52/481; 85/13; 52/511

[51] Int. Cl.[2] ..... E04H 1/00; A43B 23/20

[58] Field of Search ..... 52/238, 241, 242, 486, 52/489, 490, 479–481, 511, 359, 669, 487, 488, 700, 714, 475; 248/216, 224; 85/13

[56] References Cited

UNITED STATES PATENTS

| | | | |
|---|---|---|---|
| 1,810,597 | 6/1931 | Corwin | 52/DIG. 6 |
| 1,876,528 | 9/1932 | Walters | 52/481 |
| 2,055,442 | 9/1936 | Jones | 52/489 |
| 2,101,001 | 11/1937 | Balduf | 52/489 |
| 2,325,766 | 8/1943 | Gisondi | 85/13 |
| 2,881,924 | 4/1959 | Kruse et al. | 248/221 |
| 3,286,412 | 11/1966 | Greig et al. | 52/475 |
| 3,295,405 | 1/1967 | Burke | 85/13 |
| 3,482,369 | 12/1969 | Burke | 52/669 |

FOREIGN PATENTS OR APPLICATIONS

| | | | |
|---|---|---|---|
| 692,084 | 5/1953 | United Kingdom | 52/489 |

*Primary Examiner*—James L. Ridgill, Jr.

[57] ABSTRACT

The system comprises a metallic channel framework formed of laterally spaced, vertical studs and vertically spaced, horizontal reinforcing channel members. Prefinished gypsum board panels are equipped at the factory with suspending means comprising gang nail plates attached to the panel backs. At the job site, the upper ends of spring clips are inserted into shallow channels formed in the gang nail plates; the lower ends of the clips extend rearwardly and, when each panel is dropped into place against the framework, its clip ends engage the side lips of the reinforcing channel members to suspend the panel therefrom. The use of the inexpensive gang nail plates results in a cost saving which is applied toward including the reinforcing channel members in the structure, so as to obtain a particularly sturdy wall. Once suspended, the panels can be shifted laterally, allowing close abutment between adjoining panels to be achieved.

4 Claims, 8 Drawing Figures

1
1a
10
4
2
6
4a
5
3a
7
3
4
8
4
9

PARTITION SYSTEM FOR A BUILDING

CROSS REFERENCE TO RELATED APPLICATION

This application is a continuation-in-part of our application for U.S. letters patent Ser. No. 293,662, filed Sept. 29, 1972, now abandoned.

BACKGROUND OF THE INVENTION

The invention relates to the combination of a suspending gang nail plate with a gypsum board panel, and to a non-load bearing, demountable partition wall utilizing a channel framework of vertical studs and horizontal channels, gypsum board panels, and gang nail plate assemblies suspending the panels from the horizontal channels.

In recent years, removable partition walls have been widely used in buildings. In general, these walls involve mounting channel-like runners on the floor and ceiling, installing vertical, channel-like studs in laterally spaced relationship between the runners, and securing gypsum board or like panels to the studs.

The panels can be screwed or glued to the studs to provide a sturdy wall. However, this technique is labour intensive. It involves having to fill and tape the joints and conceal them with battens in order to produce a neat, finished appearance.

A battenless system has been developed which is described in U.S. Pat. No. 3,550,338, issued to Satkin et al. This system involves securing long metal strips with adhesive to the back of a gypsum board panel. The strips are located along each vertical side edge. Hooks protrude rearwardly from each strip. These hooks engage cut-outs in the side leg of the adjacent metal channel stud. Each hook has a cam surface, which coacts with the side edges of the cut-out to draw the panel tightly against the stud as the panel is lowered into place. The hooks suspend the panel a short distance above the floor so that the panel weight acts to hold it in place.

The metal strips which are used in this prior art system must be of substantial length and width. This requirement arises from a shortcoming characteristic of gypsum board. The bond between the board filling and the paper layer is frequently weaker in certain portions of the panel than in others. By providing long, wide strips, the patentee ensures that at least portions of each strip will be attached to properly bonded material. One disadvantage in using the strips is that they are relatively expensive and thus contribute significantly to the cost of the system.

The metal strips, hooks and stud cut-outs of this prior system must be precisely manufactured and positioned. This is done so that they match perfectly and draw adjacent panels into closely abutting relation. The joint is, under this circumstance, a line and not an unsightly gap. This precise manufacturing also contributes to the cost of the system.

Another limitation of this type of system is that considerable stress due to the weight of the panels is placed on a narrow section of the stud. This leads to sagging and weakening of the lateral stability of the wall. Reinforcing to overcome this problem is usually not added because of the increased cost.

SUMMARY OF THE INVENTION

The invention finds its genesis in the discovery that small gang nail plates are capable of suspending a soft, heavy gypsum board panel without tearing loose. In accordance with the invention, one or more of these gang nail plates are used, in conjunction with hanger members, to suspend the gypsum board panel from the horizontal channel member of a channel framework. Because the novel gang nail plates are relatively inexpensive and are easily attached to the back of the panel using mechanical means, it is feasible to include horizontal reinforcing channel members in the support framework and remain competitive, price-wise, with other systems on the market, which use only vertical studs. By suspending the panels from horizontal channel members, it is possible to use panels having loose tolerances in their dimensions and to shift the panels laterally along the horizontal channel members to achieve a close abutment and what may be termed line joints.

Each gang nail plate comprises a plate having a plurality of tangs or panel piercing members extending outwardly therefrom. The device is placed against the back of the panel and driven against it, so that the tangs pierce the panel to a substantial depth, but without protruding through the front face thereof. The tangs function to clinch the panel and plate together securely, so that the panel maybe suspended by a hanger member or clip connecting the plate and framework channel member.

In a preferred form of the gang nail plate, the tangs are punched out of the plate; they each have a curved base portion and a main section inclined slightly from a vertical plane toward the plate, when the latter is held horizontally. It has been found that when tangs of this configuration are used, they have a tendency to curve back toward the plate as they are driven into the panel, thereby increasing their purchase on the panel material.

In another preferred feature of the gang nail plate, it is formed to have a shallow channel extending upwardly from its lower side edge. A separable hanger member, comprising an upwardly extending flat portion, a rearwardly extending middle portion, and a downwardly extending lower portion, is combined with this embodiment of the gang nail plate. The upper flat portion of the hanger member is received in the plate's shallow channel and the rearwardly and downwardly extending middle portion bridges the gap between the gang nail plate and the horizontal channel member and provides a cam surface which cooperates with the leg of the channel member to draw the panel in tightly against the channel framework in a suspended condition.

This preferred form of the gang nail plate is relatively flat, allowing the panels to be piled without damage. The separable hanger member may be inserted at the job site to provide the suspension assembly.

In another preferred feature of the invention, a plurality of gang nail plates are attached in horizontal rows, so that the load is distributed and not concentrated at one point on the panel. However, it is within the purview of the invention to provide one large gang nail plate to cooperate with each horizontal channel member.

In another preferred embodiment of the invention, the partition wall structure comprises a fixed framework of conventional runners and spaced vertical studs. Cut-outs are provided in the web of each stud. The cut-outs of the spaced studs are aligned, and horizontal reinforcing channel members extend therethrough. The panels, with their suspending assemblies attached thereto, are suspended from the horizontal channel members.

DESCRIPTION OF THE PREFERRED EMBODIMENT

Figure 1:
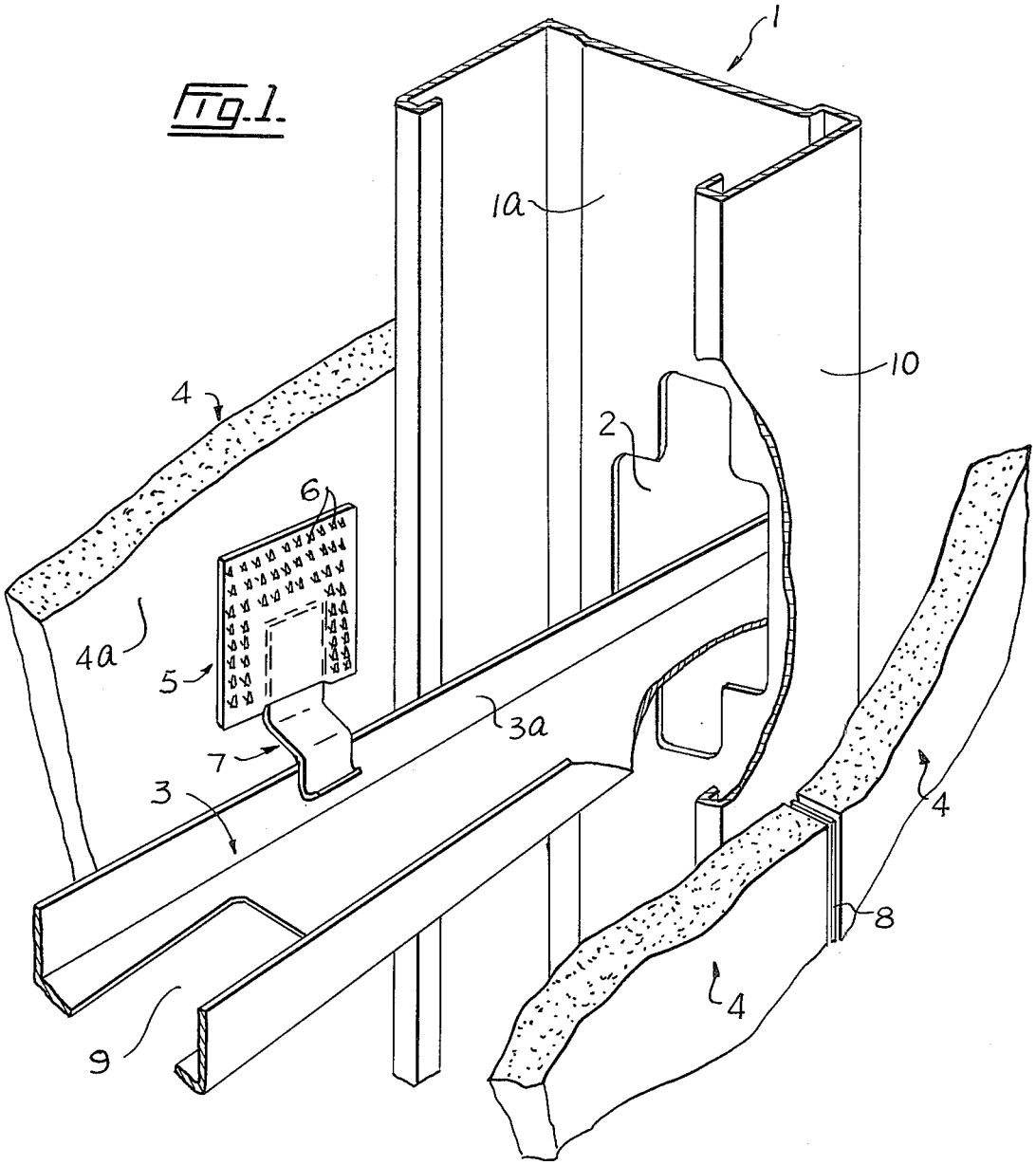
FIG. 1 is a partly broken away, perspective view showing abutting gypsum board panels suspended from a framework comprising a horizontal reinforcing channel and a vertical channel stud.

With reference to FIG. 1, a vertical stud 1 is shown having a cut-out 2 formed in its web portion 1*a*. A reinforcing channel member 3 extends through the cut-out 2. Gypsum board panels 4 are suspended from the reinforcing channel 3. A gang nail plate 5 is affixed by tangs 6 driven into the back 4*a* of the panel 4. A hanger member or clip 7 is received by the gang nail plate 5 and extends over the leg 3*a* of the reinforcing channel 3. The panels 4 are easily installed or removed from the completed stud and reinforcing channel member structure by lifting the panels 4 so that the clips 7 engage in channel 3. It will be seen that this method of panel support, in addition to providing a wall or partition structure of superior structural stability, allows lateral shifting of the panels 4 together with the clip 7. This is useful for accomodating dimension variations that can occur during installation, while at the same time obtaining tight abutment of the adjoining panels.

It is further to be noted that the stud 1 and reinforcing channel member 3 can be left exposed while electrical, telephone and other services are installed within the stud cavity in the conventional manner. Cut-out 9 is provided in the horizontal reinforcing channel 3 in order to facilitate vertical wiring or servicing.

Figure 2:
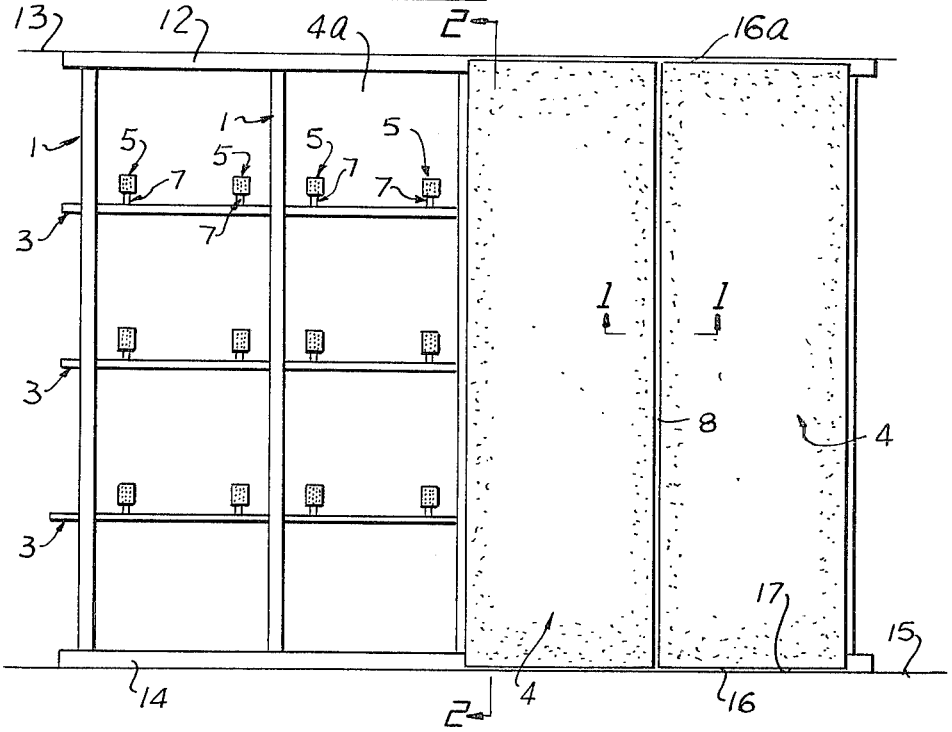
FIG. 2 is a partial elevational view of a wall or partition assembly utilizing the features of the present invention and having some of the building panels removed to show the framework.

FIG. 2 illustrates more specifically the relationship between the basic reinforced stud structure of the invention and the mounted panels 4. Ceiling runner channel 12 is fastened to the ceiling 13 and floor runner channel 14 is fastened to the floor 15. Studs 1 are fitted into channels 12 and 14 in a laterally spaced, vertical manner and reinforcing channel members 3 are laid horizontally into the studs 1 through the cut-outs 2. It will be seen that the completed stud structure is available in the conventional manner for the installation of electrical, telephone and other services and that panels 4, with gang nail plates 5 and clips 7 attached, can be easily installed or removed without tools by lifting the panels 4 so that the clips 7 engage in the reinforcing channel member 3. It can be further seen that the location of the plates 5 and the clips 7 on the back 4*a* of the panel allows for lateral adjustment of the panel without any special cutting or fitting. In addition, it is possible to cut a substantial portion or vertical piece off the sides of the panel 4 without the need to re-locate the plates 5 or clips 7. It can also be seen that space 16 is left between the bottom edge 17 of each panel 14 in the floor 15, so that the panel is suspended by the clips and is held tight to the face 10 of the vertical stud 1. Panel joints 8 are therefore flat and true without one panel edge projecting beyond the other. The spaces 16 and 16*a* are easily concealed with horizontal trim applied at the ceiling 13 and floor 15.

Figure 3:
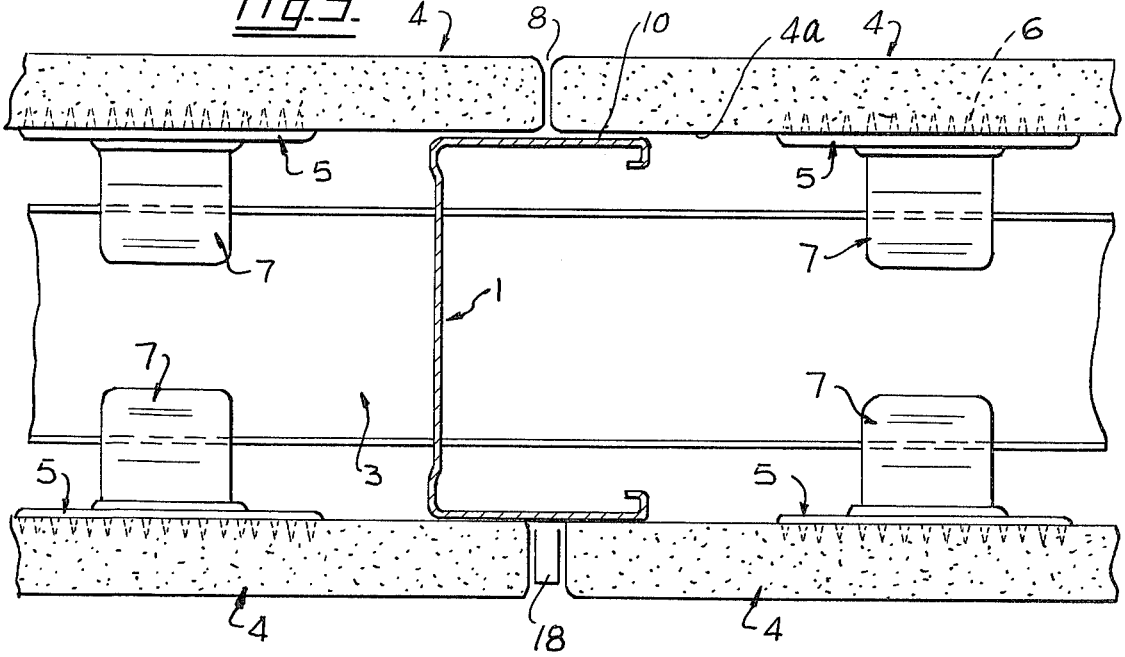
FIG. 3 is a cross sectional view of the panel joint taken along the sectional line 1—1 in FIG. 2.

It is best shown in FIG. 3 that, when the clips 7 are engaged in the reinforcing channel member 3, the backs of the panels 4 lay tight up against the face 10 of the stud 1. If required, for special joint affects, the panels 4 can be shifted laterally to allow for the application of feature strip material such as 18.

Figure 4:
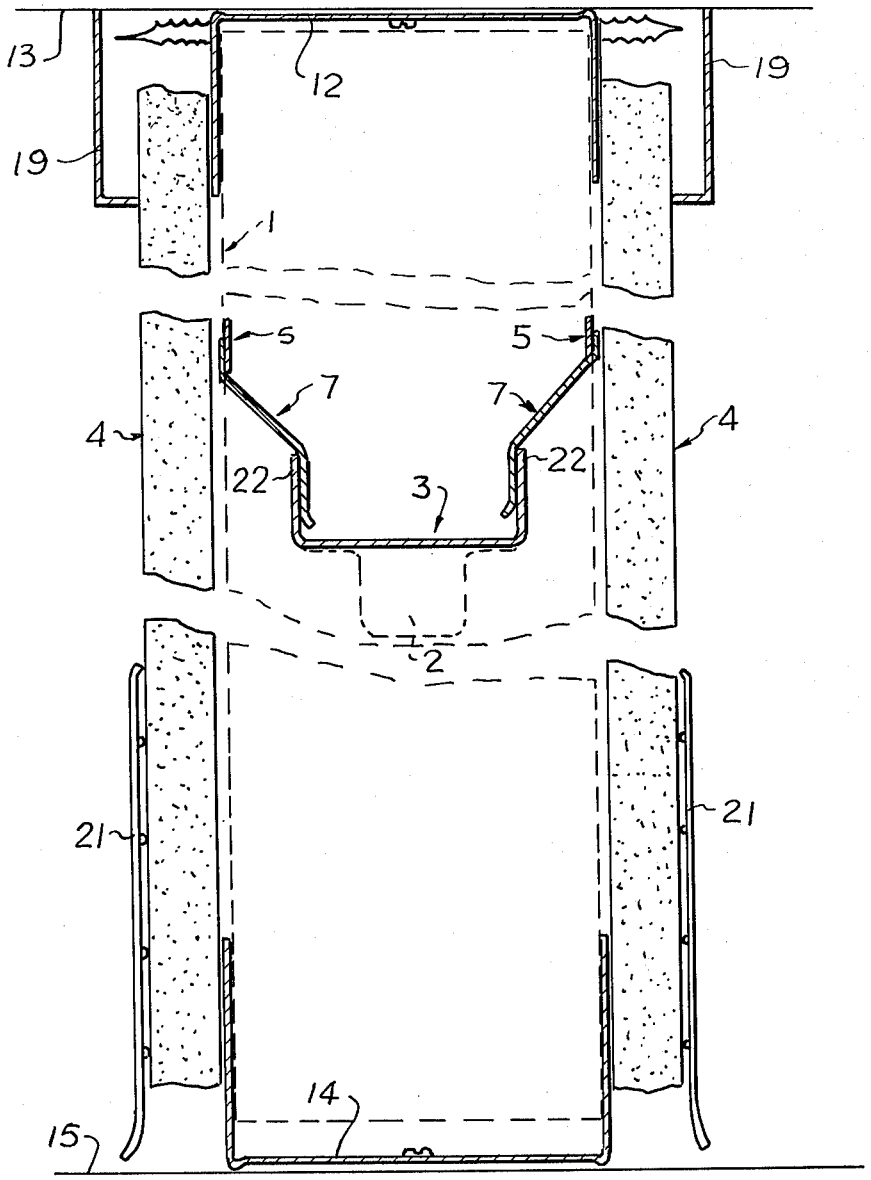
FIG. 4 is a vertical sectional view taken along the sectional line 2—2 in FIG. 2.
Figure 5:
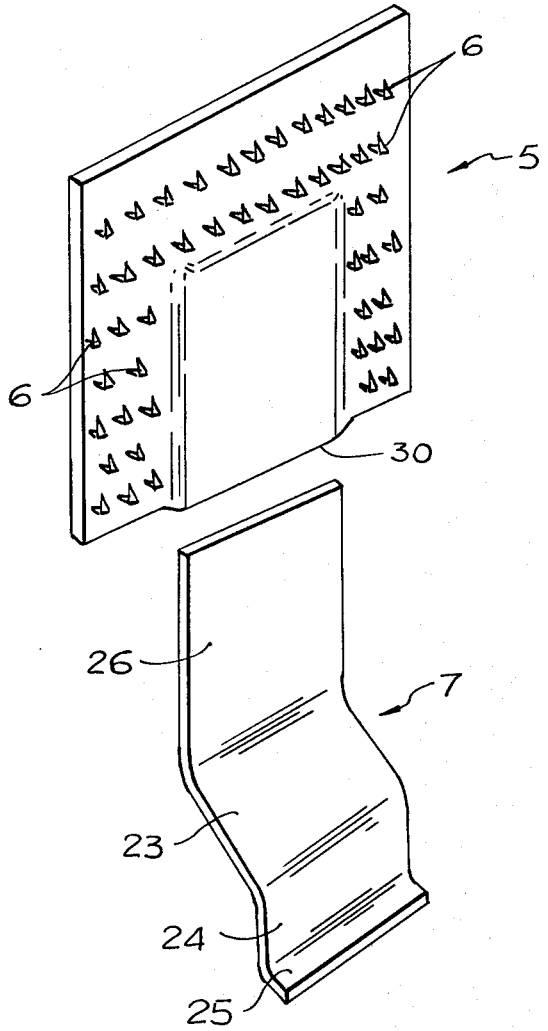
FIG. 5 is an enlarged perspective view of the clip holder and the clip.

As shown in FIG. 4, stud 1 is installed in a vertical position into channels 12 and 14 and reinforcing channel member 3 is fitted into the stud cut-out 2. Clips 7 rest on the upper lip 22 of the reinforcing channel member 3 and so provide support for the building panels 4. Suitable trims 19 and 21 are applied to complete the finished appearance of the wall or partition structure. FIG. 5 shows the construction of one embodiment of gang nail plate 5 and clip 7. Plate 5 has a plurality of projecting tangs 6 which are designed to give a secure mechanical fastening to gypsum board building panels. We typically use six 2 inches × 4 inches plates, each having 50 ⅜ inches long tangs, to suspend a ½ inches × 30 inches × 9 feet gypsum board panel weighing about 45 pounds. Surprisingly the panel is satisfactorily suspended for a long period of time without tearing or other problems. It will be noted that each gang nail plate 5 has a length and width which are both only a small fraction of the length and width of the panel 4.

A shallow, projecting channel 30 is provided in plate 5. Clip 7 is inserted into channel 30 just prior to installation of the building panels. Clip 7 is provided with a slide-in portion 26 which fits the channel 30. It also has a sloped or cam portion 23 which gives a tight spring fit as the clip 7 drops into the reinforcing channel 3. Sections 23 and 24 on clip 7 are so arranged that panels 4 are pulled tight to the stud facing 10. Flared out portion 25 of clip 7 facilitates the engagement of the clip over the lip 22 of the channel member 3.

Figure 6:
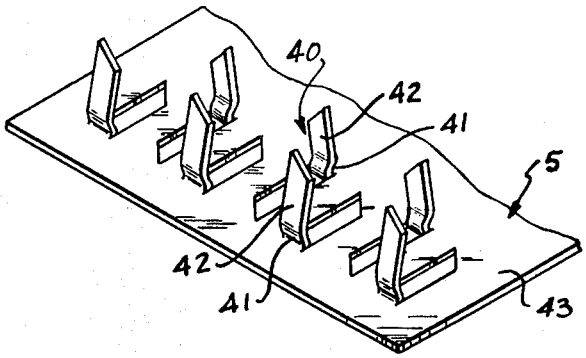
FIG. 6 is a perspective view of the preferred form of gang nail plate.
Figure 7:
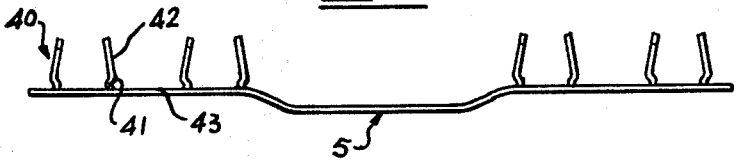
FIG. 7 is a side view showing the preferred configuration of the tangs of the gang nail plate, prior to being driven into the gypsum board panel.
Figure 8:
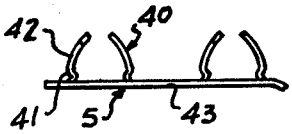
FIG. 8 is a side view similar to FIG. 7, showing the shape of the tangs after they have been driven into the panel.

Turning to FIGS. 6 – 8, a preferred embodiment of gang nail plate 5 is shown. The tangs in this case are formed in rows, with adjacent integral tangs 40 being punched out of the plate in opposed relation. Each tang 40 has a curved base portion 41 and main section 42 inclined slightly from the vertical plane toward the horizontal plate 43. When driven into the gypsum board panel, the tangs curve inwardly toward the plate as illustrated by a comparison of FIGS. 7 and 8.

It can be seen from the foregoing description that the present invention provides an improved way of building a wall or partition structure and that the indicated objects and features of the invention would be accomplished.

Although this invention has been described with respect to its preferred embodiment, it should be understood that many variations and modifications will be obvious to those skilled in the art and it is preferred that we not be limited to the specific form or uses mentioned, except to the extent of the appended claims.

What is claimed is:

1. A building partition wall comprising:

first and second runner members mounted horizontally on a ceiling and floor respectively in confronting relationship;

a plurality of spaced, vertical stud members extending longitudinally between the runner members and cooperating therewith to form a solid framework, each stud member having at least one cut-out extending therethrough, said cut-out in one stud member being aligned with a cut-out in each other stud member;

one or more horizontal channel members, each extending through a series of said aligned cut-outs and having an upwardly extending side leg;

a plurality of gypsum board panels, each suspended in side by side relationship from the horizontal channel member or members;

and a plurality of suspension assemblies affixed to the rear of each panel in spaced relationship, said suspension assemblies attaching the panel to said channel members;

each said suspension assembly comprising a gang nail plate and a separable hanger member, each said gang nail plate comprising a plate and a plurality of integral, panel-piercing, non-threaded members projecting from the plate and extending into the panel without protruding through the front face thereof;

each said hanger member having a cam surface which cooperates with a side leg of the horizontal channel member from which it is suspended to draw the panel firmly against the adjacent vertical stud members.

2. The building partition wall as set forth in claim 1 wherein:

the gang nail plate has a length and width which are both only a small fraction of the length and width of the panel.

3. The building partition wall as set forth in claim 2 wherein:

the suspension assemblies are affixed to the panel in one or more horizontal rows for cooperating with the horizontal channel members.

4. The building partition wall as set forth in claim 2 wherein:

each gang nail plate has a shallow channel formed therein extending upwardly from its lower side edge, for receiving the hanger member;

said hanger member comprising an upwardly extending flat portion, received in the shallow channel, and a rearwardly and downwardly extending portion providing the cam surface.

* * * * *